United States Patent [19]

Karis

[11] 4,359,218

[45] Nov. 16, 1982

[54] CONTINUOUS SHEET COLLECTION AND DISCHARGE SYSTEM

[75] Inventor: Arthur T. Karis, Lenox, Mass.

[73] Assignee: Beloit Corporation, Beloit, Wis.

[21] Appl. No.: 162,136

[22] Filed: Jun. 23, 1980

[51] Int. Cl.[3] ..... B65H 29/50; B65H 29/70; B65H 31/10; B65H 31/32

[52] U.S. Cl. ..... 271/188; 271/189; 271/191; 271/201; 271/213; 271/218; 414/50; 414/114; 414/907; 100/264

[58] Field of Search ..... 271/218, 217, 213, 189, 271/191, 201, 188; 414/50, 114, 907; 100/264

[56] References Cited

U.S. PATENT DOCUMENTS

| | | | |
|---|---|---|---|
| 2,843,377 | 7/1958 | Battersby | 271/188 |
| 2,853,299 | 9/1958 | Link et al. | 271/218 X |
| 2,960,243 | 11/1960 | Beaulieu | 271/218 X |
| 3,131,819 | 5/1964 | Ducayet | 271/213 X |
| 3,180,638 | 4/1965 | Meylan | 271/159 |
| 3,231,100 | 1/1966 | Raeber | 271/218 X |
| 3,525,444 | 8/1970 | Brockmüller | 271/217 X |
| 3,567,046 | 3/1971 | Reist | 414/907 X |
| 3,908,985 | 9/1975 | Wiseman | 271/189 |
| 4,147,340 | 4/1979 | Butts | 271/218 |
| 4,162,649 | 7/1979 | Thornton | 271/218 X |

FOREIGN PATENT DOCUMENTS

| | | | |
|---|---|---|---|
| 1503148 | 3/1978 | United Kingdom | 271/218 |

*Primary Examiner*—Bruce H. Stoner, Jr.

*Attorney, Agent, or Firm*—Hill, Van Santen, Steadman, Chiara & Simpson

[57] ABSTRACT

A collector and discharge mechanism permits a continuous flow of sheet material into a stacker station while predetermined size batches are removed from the growing stack and discharged for processing and cartoning. The mechanism includes a kick-off assembly for passing sheets into the stacker, a vertically movable support table on which the sheet pile collects in the stack, an interrupter mechanism for projecting a plate piece between successive sheet deliveries into the stacker over the last sheet on top of the batch to be removed, a divider assembly for separating the continually growing stack in the stacker from the top of the batch and separately supporting the stack on spears, an elevator for raising the delivery end of the kick-off assembly while the spears hold the growing stack in the stacker to obviate the risk of sheet delivery jam-ups, and a discharge conveyor for receiving the removed batch from the support table, after which the table returns to the stacker to resume support for the growing stack.

35 Claims, 19 Drawing Figures

FIG 3
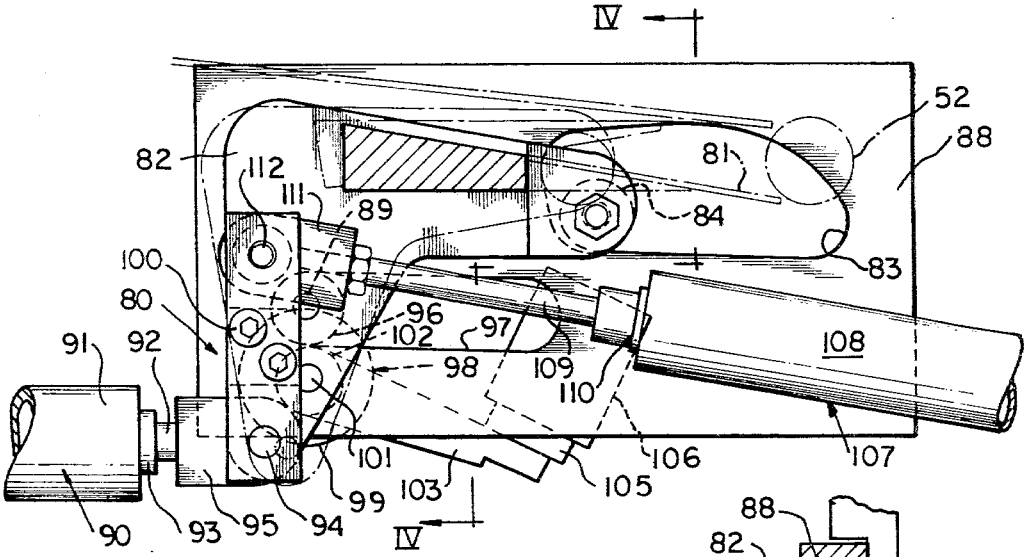
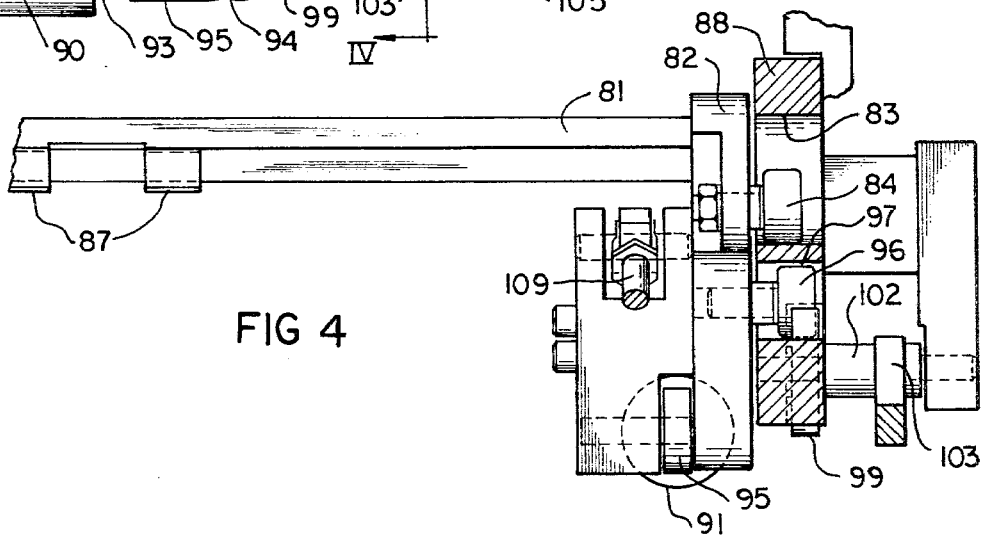
FIG 4
FIG 5
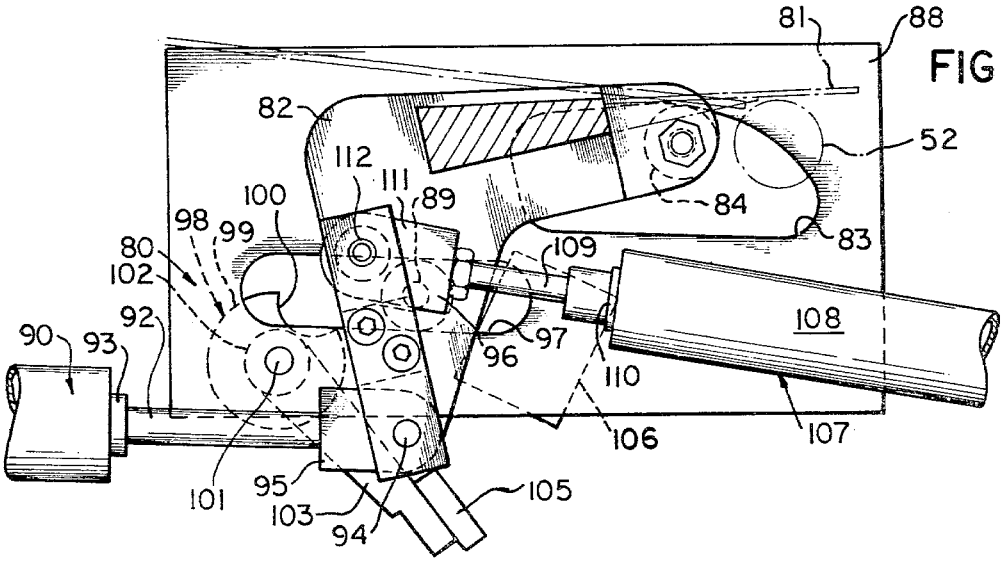

56
52
127
128
125
122
141
129
131
133
130
132
142
168
169
121
167
147
154
149
IX 56
52
127
137
124
124b
123b
123a
124a
121
123
126
136
130
133
132
168
169
142
167
166
145
154
148
164
163
150
151
152
149
153
162
155
157
160
165
171
173
172
158
146

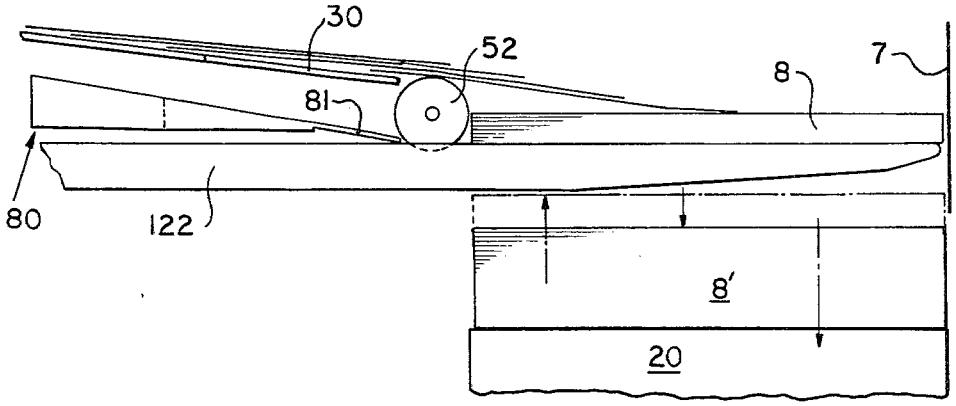
FIG. 14
FIG. 15
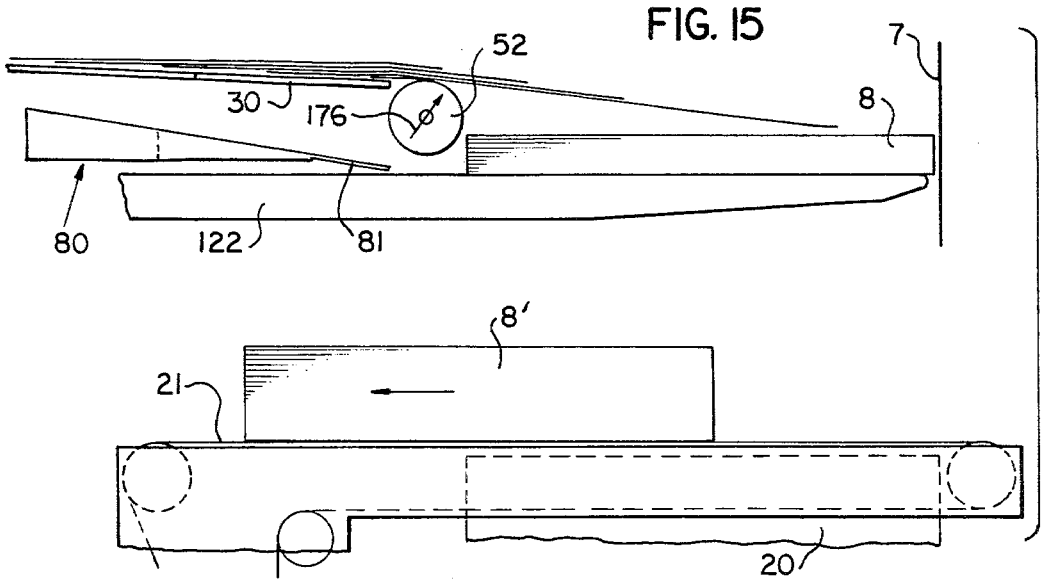
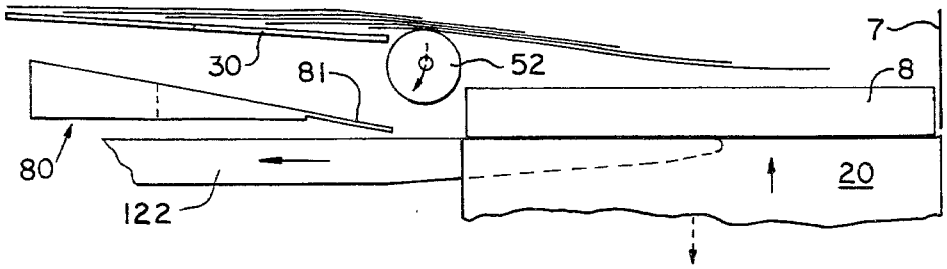
FIG. 16
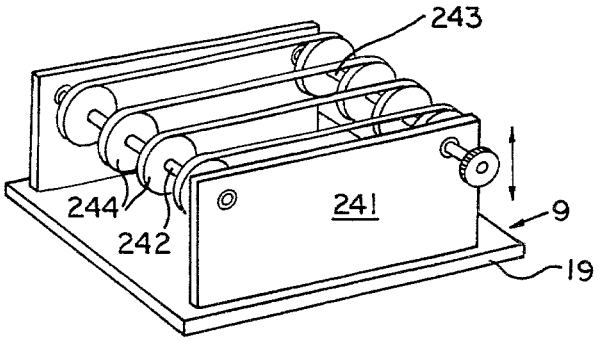
FIG. 19

CONTINUOUS SHEET COLLECTION AND DISCHARGE SYSTEM

BACKGROUND OF THE INVENTION

A. Field of the Invention:

The invention relates to the handling of sheet material and, more particularly, is directed to a method and apparatus for collecting a continuous flow of sheet while simultaneously discharging sheet piles of predetermined size.

B. The Prior Art:

Sheets, particularly of paper, may issue from a sheeting machine which shears the sheets from a continous web. The sheets are advanced seriatim along a delivery conveyor system to a collector device where the sheets collect into piles. Some form of mechanism is required to accommodate the growing stack in the collector. One known mechanism enables the delivery unit to be raised in concert with the growing stack; whereas the more typical assembly causes the sheets to collect on a reciprocable platform or table which descends at the growing rate of the stack. Whatever system is employed, there comes a time when the stack reaches a predetermined size for packaging, which may range in height from one inch or less to several feet, and the stack must be removed. Stack removal has represented a fundamental problem with sheet handling. All the heretofore schemes which successfully collect and discharge sheet stacks from a collector have involved compromises in versatility, efficiency, operator accessibility, and mechanical simplicity.

One approach has been to use two collection and discharge stations to which delivery flow of sheet is alternately diverted after a preset number of sheets is sensed by an electronic counter. The disadvantage with this approach has been that it requires complex machinery and essentially requires the cost of a second collector station.

Another common practice has been to interrupt or hesitate the flow of sheets along the delivery conveyor while a stack is being removed from the collector. The deceleration and acceleration periods often cause erratic machine performance, which may result in haphazard stacks.

A further approach has been to utilize a primary tray in the collector to accumulate a sheet stack and a second tray nearby to act as a waste collection bin. After the predetermined number of sheets have collected in the primary tray, sheet flow is diverted into the secondary tray. Rods are then moved into place over the top of the finished stack in the primary tray. The sheet flow is transferred back into the collector such that the sheets accumulate on top of the rods, while the primary tray is lowered away for removal of the completed stack. The emptied primary tray is returned to the collector, whereupon the rods are withdrawn, depositing the sheets which have accumulated thereon into the primary tray. Sheet flow continues into the primary tray and the process repeats. The problem with this approach is that the waste tray must be periodically emptied and readjusted for changes in sheet size and grade. Further, in order to avoid wasting sheets collected in the second tray, extra mechanical devices may be required to render stacks accumulating in the second tray fit for packaging.

U.S. Pat. No. 4,162,649 to John Thornton discloses a still further approach in which sheets delivered into a collector accumulate on a table moving downwardly in accordance with the growing rate of the stack. The stack is divided into desired batches of sheets by means of horizontal bars applied from behind the collector and placed between successive sheet deliveries. A divider is moved progressively downward with the table until it is ultimately arrested by a crosshead member. As the stack continues to descend, a gap is created between the underside of the divider and the uppermost sheet of the batch of sheets on the table. Creation of this gap generates a signal which causes a sheet support plate to travel forward into the stack and completely divorce the main stack from the batch resting on the table. The support plate travels downwardly at the growing rate of stack; while the table now moves downward at a higher speed to convey the separated batch of sheets to a discharge station where the batch is removed from the table. The emptied table is returned to the collector, whereupon the sheet support plate is withdrawn and deposits the stack back onto the table for the process to repeat. Some drawbacks with this system are that access into the collector from behind is precluded by the divider and that a cumbersome drive and travel guidance arrangement is necessary to permit the correlated movement of the support plate in the collector.

The present invention enables sheet delivery flow into a collector to be smooth and continuous, while simultaneously separating and removing sheet batches of predetermined size from the collected stack. The present invention uses a simplified mechanical arrangement which is relatively less wasteful of space without compromising production efficiency or stack quality. The invention has other advantages over prior art schemes as those skilled in the art will appreciate from the discussion below.

SUMMARY OF THE INVENTION

Sheets, particularly of paper, flow from a low speed delivery conveyor into a collector and discharge system which enables the sheet to accumulate and be separately removed in desired batches without interrupting or hesitating sheet delivery flow. After a predetermined number of sheets have accumulated on a stack being supported upon a downwardly moving table within a stacker, an interrupter bar or plate intercedes a short distance within the stack from the bottom of the succeeding sheet stack. The stack support table continues to move downwardly relative to the interrupter such that a gap is created into which spear-like support arms are transversely inserted into the collector. The interrupter withdraws from the sheet stack and the support spears serve to separately support the succeeding sheet stack accumulations stationarily within the collector. A discharge platform from which sheets are delivered into the stacker is made vertically movable so that it can ascend slightly while the stack is being stationarily supported on the spears to avoid obstructing delivery flow with sheets as they accumulate on the stack. Meanwhile, the predetermined batch is transported by the movable table to a discharge means which delivers the sheet batch for further processing and packaging. The empty table returns to the stacker, whereupon spaced-apart carrying columns formed on the table pass between the spears and lift the stack from the spears. After the spears have been unloaded, they retract from the collector to their original position. The support table begins its descent once again in the collector; and the kick-off platform lowers to its original position. When the kick-off platform reaches its lowermost position, the stack support table continues to descend at the growing rate of the stack and the process repeats.

BRIEF DESCRIPTION OF THE DRAWINGS

FIG. 3 is a fragmentary vertical cross-section view of an interrupter device according to the present invention.

FIG. 4 is a cross-sectional view taken along the lines IV—IV of FIG. 3.

FIG. 5 is a vertical cross-section view of the interrupter device illustrated in FIG. 3 in its firing positions.

FIGS. 10–16 are diagrammatic representations of the collector mechanism according to the present invention illustrating various positions of the parts during operation.

FIG. 19 is a perspective elevational view of an alternate table arrangement having conveyor means incorporated therein.

DESCRIPTION OF THE PREFERRED EMBODIMENT

The preferred embodiment relates to the collecting and discharging of batches or reams of paper sheets. However, other sheet material, such as board of cardboard, may also be handled by the present invention.

Figure 1:
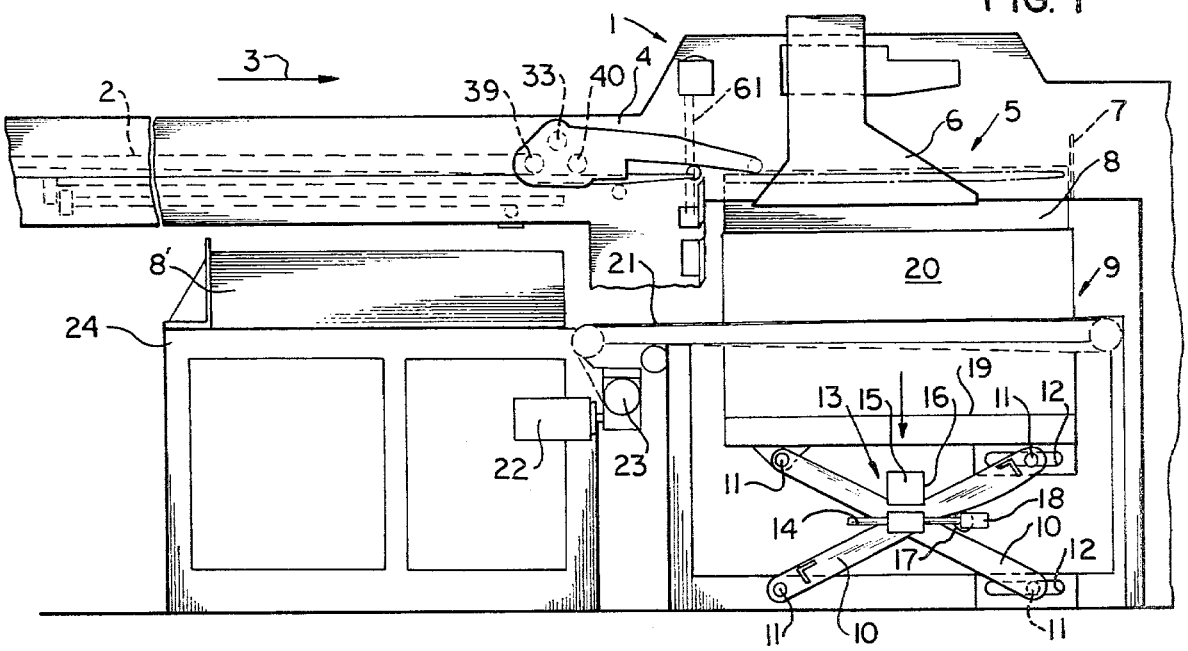
FIG. 1 is a side elevation of a sheet collector mechanism according to the present invention.
Figure 2:
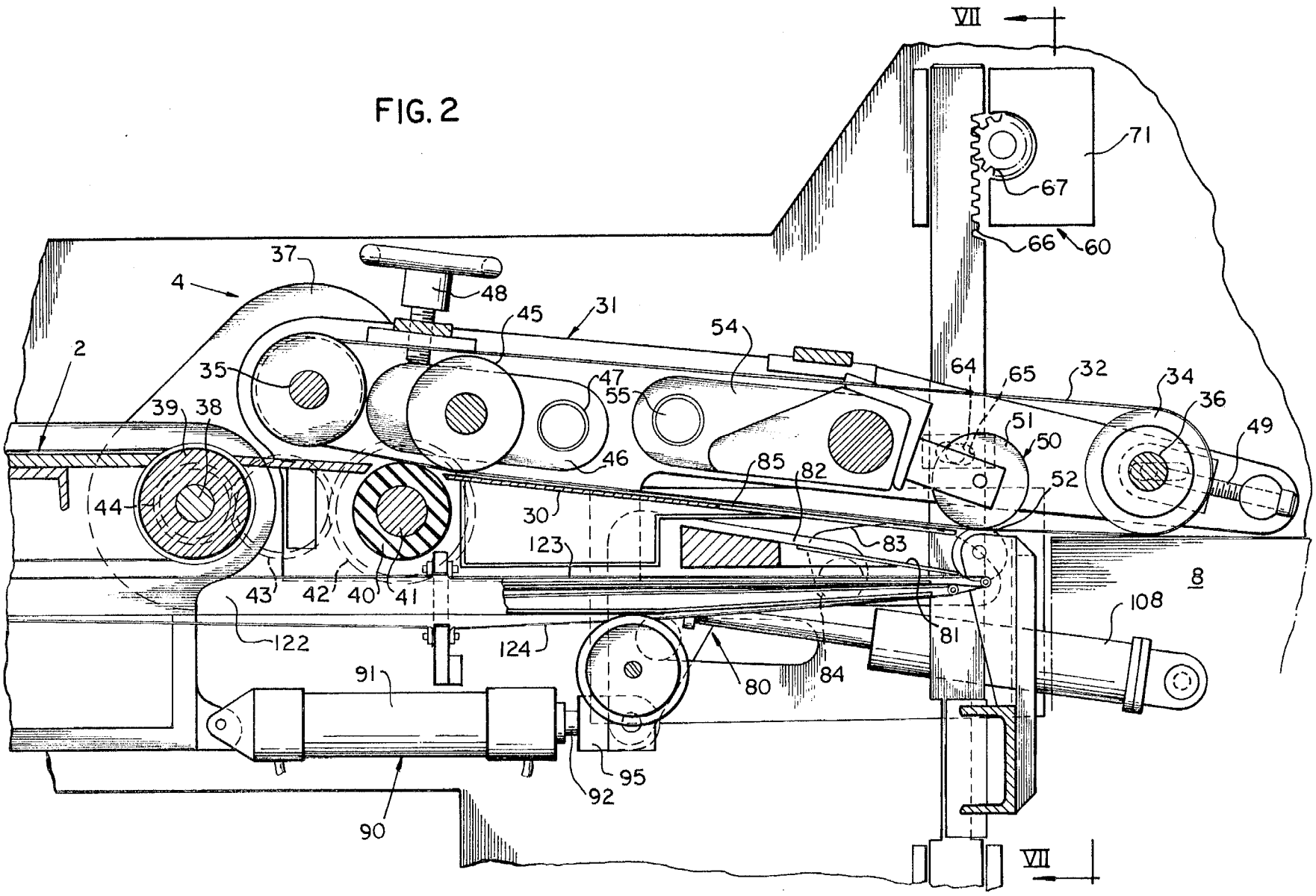
FIG. 2 is a fragmentary vertical cross-section view of the sheet delivery platform and adjacent mechanisms for the collector mechanism illustrated in FIG. 1.
Figure 7:
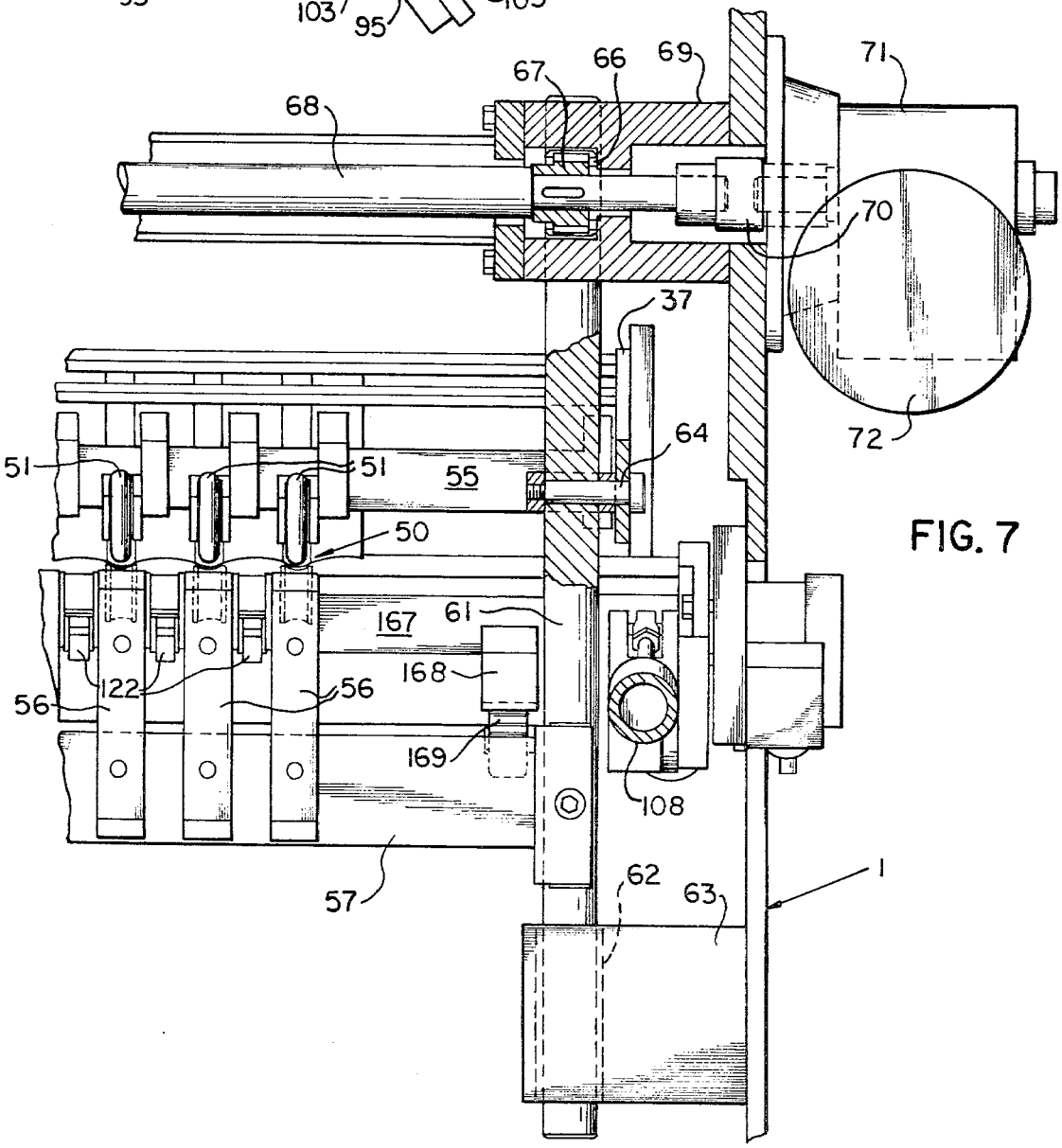
FIG. 7 is a cross-section view taken along the lines VII—VII of FIG. 2.

A collector and discharge mechanism according to the present invention is generally shown at 1 in FIGS. 1, 2, and 7. Not shown in FIG. 1, but upstream of the mechanism 1, there is a sheeting machine for cutting a web of paper into sheets and a high-speed conveyor system for passing the paper sheets seriatim to a downstream low-speed delivery conveyor 2, which may take the form of a series of parallel conveyor tapes or belts. The changeover in speed between the high speed conveyor and the low speed conveyor gives a shingled effect to sheets being passed along the low speed conveyor. Sheet product is fed in the direction of arrow 3. From the low speed conveyor, sheets are passed through a kick-off assembly 4 and into a stacker station 5. The stacker station comprises vertical side plates 6 for bounding the side edges of sheet being delivered into the stacker and an elongated vertical back plate 7 for stopping the forward travel of the sheets. After the leading edge of a sheet engages with the back plate 7, the sheet descends to the top of a paper stack 8 being formed in the stacker.

Operation of the mechanism 1 is described herein in terms of a single sheet flow; however, the web may be cut to create plural side-by-side sheet flows to the stacker station 5. Plural side plates 6 may be mounted in the stacker to segregate the stacks resulting from the plural flows.

The stack 8 is supported on a table means 9 which is vertically movable by relative collapsing of support legs 10. The legs 10 are pinned for pivotal movement about shafts 11 at each opposed end. As shown in FIG. 1, the right-hand pins 11 are free to travel in horizontally elongated slots 12. Collapsing of the legs 10 is provided by means of a screw drive arrangement 13 having a stationary screw member 14 along which travels a rotary bolt piece driven by a multiple speed electric motor 15. The bolt and motor are contained in a casing 16 secured to an outer leg. Riding along the upper side surface of the adjacent inner leg is a roller 17 which is connected to an end cap 18 formed at one end of the screw 14.

The table 9 comprises a base platform element 19, the undersurface of which is formed with connection pieces to which the upper ends of the support legs 10 are attached. A series of spaced-apart columns 20 extend vertically from the upper surface of the table platform. Each column is generally rectangular with a longitudinal axis parallel to the longitudinal axis of the mechanism 1 as shown in FIG. 1. The upper surfaces of the columns 20 serve to carry the growing sheet stack 8 in the stacker station 5.

Interspaced between the table carrying columns 20 are a series of lateral belt conveyors 21 driven by a common electric motor 22 through a series of drive rolls 23. The belt conveyors 21 serve to discharge a predetermined number of sheets in a batch 8' removed from the growing stack 8 onto a discharge table assembly 24 after the upper carrying surfaces of the table 9 have descended beneath the level of the conveyor belts 21 in a manner described more fully below. The discharge table is equipped in a known manner to receive sheet batches for further processing and packaging.

Referring now to FIGS. 2 and 7, the kick-off assembly 4 includes a platform or chute means 30 underlying an overhead belt conveyor 31. The platform is a relatively friction-free surface for the smooth flow of sheets thereover enroute to the stacker 5. The platform may be formed of stainless steel, Formica, or a plate perforated to emit a current of gas, such as pressurized air. The conveyor 31 utilizes a series of spaced-apart conveyor belts 32 to engage and propel the upper surfaces of the sheet flow from the low-speed conveyor. The belts 32 extend about opposed end idler rolls 33 and 34. The idler rolls are supported on shaft members 35 and 36 mounted in side plates 37 forming a kick-off assembly housing. The kick-off housing is pivotable about the axis of a shaft 38 about which are also mounted a series of downstream rolls 39 for the belts of the low-speed conveyor 2. The overhead conveyor belts 32 are driven by frictional engagement with a series of cooperatively arranged rolls 40, the upper surfaces of which extend about the delivery platform surface. The engagement rolls 40 are contained on a rotary shaft 41 having drive transmission gears 42 formed at opposed exterior ends thereof. The gears 42 are drivingly engaged by idler gear means 43 in turn driven by sprockets 44 carried on exterior opposed ends of the shaft 38. The various drive transmission gears are sized such that the speed of the overhead conveyor belts 32 matches the low-speed conveyor.

The overhead conveyor belts 32 may utilize known tensioning devices such as shown in FIG. 2. For example, a roll 45 resting on the upper side of a belt as it passes beneath the rolls 35 and 36 is supported on a plate 46 for pivotable movement about a shaft 47 in response to an adjustment of a tensioning screw 48. A further tensioning device is illustrated in which the relative lateral position of roll shaft 36 is controlled by a screw 49, one end of which is pinned to shaft 36.

A series of spaced-apart corrugating roller assemblies 50 press down on the belts 32. The roller assemblies are mounted on the kick-off assembly housing so as to be positioned just downstream of the leading edge of the delivery platform 30. The assemblies 50 are each comprised of an upper roll 51 and lower roll 52 having parallel axes. The upper roll 51 has a concave outer surface received in a convex outer surface for roll 52. Each upper roll is mounted for free rotation at the end of an arm member 53. The arm 53 is mounted at the forward end of a plate piece 54 which is pinned for pivotable movement about a shaft 55 located adjacent the rearward portion of the plate 54. The shaft 55 is mounted in the kick-off assembly housing in similar fashion with roll shafts 35 and 36. Each lower roll 52 is supported at the open end of a vertical bracket 56 connected to a transverse beam piece 57 as shown in FIG. 7. The beam 57 is secured at its opposed ends intermediate of vertically extending bar members 61 to be described in further detail below. The corrugating roller assemblies 50 form longitudinal corrugations along the sheets as they are propelled out over the sheet stack 8. The corrugations serve to stiffen the sheets to assure their effective travel into jogging relationship with the stacker stop plate 7.

A kick-off assembly elevator device 60 is provided for purposes described more fully below. The elevator comprises two vertically extending rack bars 61 which are positioned spaced from one another across the width of the mechanism 1 and adjacent respective kick-off assembly housing side plates 37. The lower end of each bar 61 passes freely through a guide channel 62 formed in a bracket 63 secured to stationary mechanism structure. Somewhat adjacent the side plate connection with the upper corrugating rolls pivot shaft 55, pin members 64 extends from each bar 61 into an elongated slot 65 (FIG. 2) formed in the adjacent side plate 37 of the assembly 4. The upper end of each bar 61 is formed with rack teeth 66 drivingly engaged with the teeth of a reversible pinion 67. The pinions 67 are supported on a common shaft 68 which extends across the width of the mechanism 1 and is supported for rotation by bracket means 69. One exterior end of the shaft 68 is connected by coupling 70 into driving connection with a transmission means 71 driven by a reversible electric motor 72.

To record the arrival of a predetermined number of sheets onto the support table 9, an interrupter device 80 is provided. The interrupter serves to thrust a plate portion 81 upwardly into the flow of delivered sheets and then out onto the top of the stack of sheets at the correct count to indicate the top of a batch 8' between successive sheet deliveries. At rest, plate 81 extends in a direction generally transverse to the sheet stacker 5 and has spaced-apart leading edges 87 generally underlying the upper corrugating rolls 51. In its at rest position, the leading edge surfaces of the plate 81 face the lower corrugating rolls 52 and extend beneath the delivery plane of the platform 30. At opposed ends of the plate 81, the trailing edge surface of the plate 81 is fitted in the upper leading portion of generally L-shaped link members 82. At these upper leading portions, each link member 82 is made to follow a generally semi-circular shaped cam track 83, guided therealong by a follower roller 84. A space 85 is formed in the surface of the delivery platform 30 to permit passage of the plate 81 therethrough into engagement with the sheet flow. As the interrupter plate presses upwardly against the bottom surface of a sheet, the plate biases the upper corrugating rolls 51 upward about their pivot shaft 55.

With reference to FIGS. 3–6, detailed operation of the interrupter 80 will be discussed. A trigger signal from a sheet counter system such as one further described below activates a distributor valve for a fluid motor arrangement 90 to propel the interrupter 80. Respective motor means 90 are drivingly connected to each link 82. Each motor 90 comprises a double-acting piston movable in a cylinder 91. A piston rod 92 extends laterally forward from the cylinder end 93 toward the stacker station 5. A pivot pin 94 connects a lower end portion of the link 82 to a crosshead member 95 secured upon the outer end of the piston rod 92. Located intermediately along each link member 82 is a second follower roller 96 mounted for rotation about a pin shaft 89 extending outward from the link 82. Each roller 96 is contained in a laterally directed cam slot 97. The slot 97 is formed in a stationary mechanism wall 88 also containing the cam track 83 and is located beneath that track.

A brake mechanism 98 is utilized in conjunction with each lower roller 96 during the initial firing of the interrupter. The brake mechanism comprises a latch wheel element 99 provided with a semi-circular opening 100 for concentrically fitting about and containing the follower roller 96 at the rear end of the slot 97. The latch element is rotatable about a fixed shaft 101 together with a hub member 102 from which extends a pivot arm 103. The arm 103 extends radially outward from the shaft 101 and includes a steel disc 105 formed on or fixed to its outer end. The weight of the arm 103 and disc 105 tends to rotate the pivot arm 103 in a clockwise direction about the shaft 101 as viewed in FIGS. 3 and 5. A solenoid 106 magnetically attracts and holds the disc 105 fixed to the pivot arm 103 against clockwise travel of the pivot arm 103. The solenoid is normally energized. When current to the solenoid is broken, the solenoid 106 releases the latch arm, allowing the latch arm to rotate in the clockwise direction. This movement turns the open end of the cut-out portion 100 to permit the roller 96 to travel forwardly in the slot 97. When the roller 96 is returned at the end of the interrupter stroke, it engages the cut-out wall 100, driving the wheel 99 counterclockwise and bringing disc 105 once again into a position proximately facing the solenoid for securement thereto.

When the motor pistons are initially pressurized and being moved rightward, the lower rollers 96 are held at the rear ends of their cam slots by the latches 99. Each piston rod then biases the lower end of the interrupter plate 81 to pivot about the axis of pin shaft 89 such that the upper follower 84 travels upwardly along the rearward wall portion of the cam track 83. Accordingly, the interrupter plate 81 is in its "ready" position just beneath the flow of sheets along the downstream edge of the kick-off platform 30 as shown by the dotted lines in FIG. 3.

At the appropriate moment, the current to each solenoid 104 is broken to cause release of the lower roller 96 as shown in FIG. 5. Due to building pressure in the motor 90 and the proximity of the leading edges of the plate 81 to the undersurfaces of the delivered sheets, the plate 81 immediately enters into the sheet flow through the platform opening 85 and upraises the undersurface of a predetermined sheet. The motor pressure on the piston rods 92 causes the interrupter plate 81 to move forward along the upper surface of the guide track 83.

A damping mechanism 107 is utilized to effect proper positioning of the interrupter link member 82 during movement of the interrupter. The damper comprises a cylinder 108 filled with hydraulic fluid and containing a piston to divide the cylinder into first and second longitudinally spaced chambers. The piston may be formed with a leak hole freely interconnecting the two chambers and be secured at the end of a piston rod 109 which extends outward from a rearward end 110 of the cylinder facing the interrupter mechanism. The outer end of the piston rod 109 is formed with a crosshead member 111 which is pivotally connected to the plate member 81 at a pin shaft 112. The damping mechanism 101 serves to prevent abrupt acceleration of the interrupter mechanism during its operation, thereby maintaining the plate 81 in a pivoted condition even after the lower roller 96 is released in the slot 97.

Figure 6:
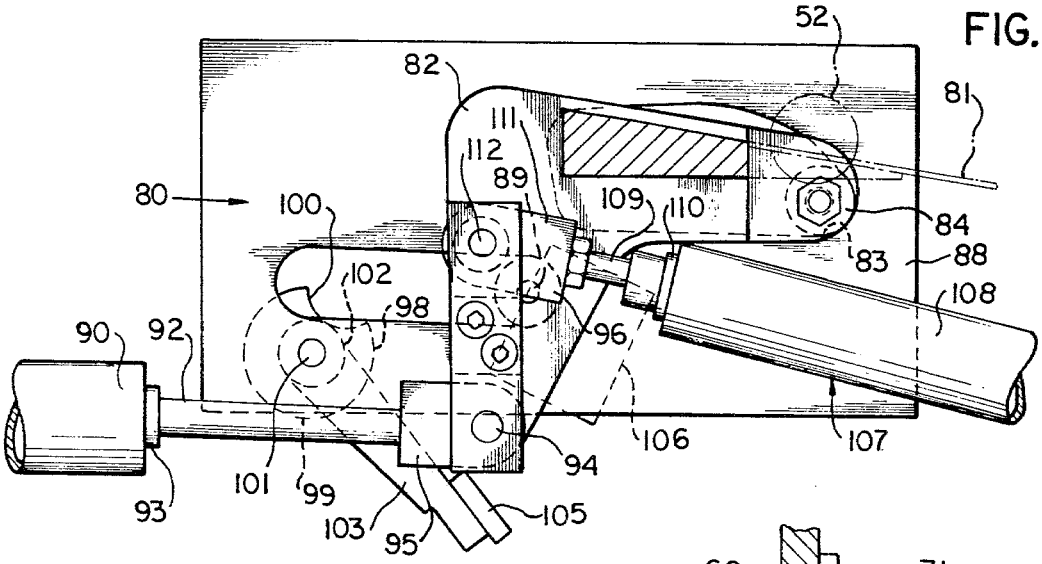
FIG. 6 is a vertical cross-section view of the interrupter device illustrated in FIGS. 3 and 5 at its lowermost position within the sheet stack.

Because each plate 81 remains in a pivoted condition due to the damper 107, each upper follower roller 84 travels along the upper surface of the track 83 as the lower roller 96 is passed forward in slot 97. During this time, the plate 81 passes out over the trailing edge of the stack 8 and then descends to extend nearly parallel with the top sheet on the stack. When the lower roller reaches the forward end of slot 97, the upper cam roller 84 will have been driven to the lower forward portion of the cam track 83 such that the interrupter plate 81 is fully extended into the paper stack 8 as illustrated in FIG. 6. Each interrupter plate 81 will have become vertically righted about the pin 89 when the roller 96 reaches this point. Movement of the interrupter is halted for a brief period during which the sheet support table 9 continues to be lowered. In this manner, interrupter plate 81 causes a gap or cleft to form at the edge of the paper stack between the successive sheets which the plate divides. Fluid pressure is then reversed in the fluid motor means 90 such that the piston arm 92 is driven laterally rearward away from the paper stack. On its return stroke, the interrupter mechanism travels substantially parallel to a divider assembly 121 positioned directly beneath it as the rollers 84 and 96 both travel along linear cam track portions.

After the support table 9 has reached a predetermined point in its descent such that the gap mentioned above is formed, a signal is sent to the divider assembly 121. The divider assembly extends laterally through the collector and discharge mechanism 1. The assembly includes a row of spaced-apart spears 122 which extend laterally toward the stacker station 5. Stationary wall member 125 extends above the spears in a plane perpendicular with the longitudinal axes of the arms.

Figure 8:
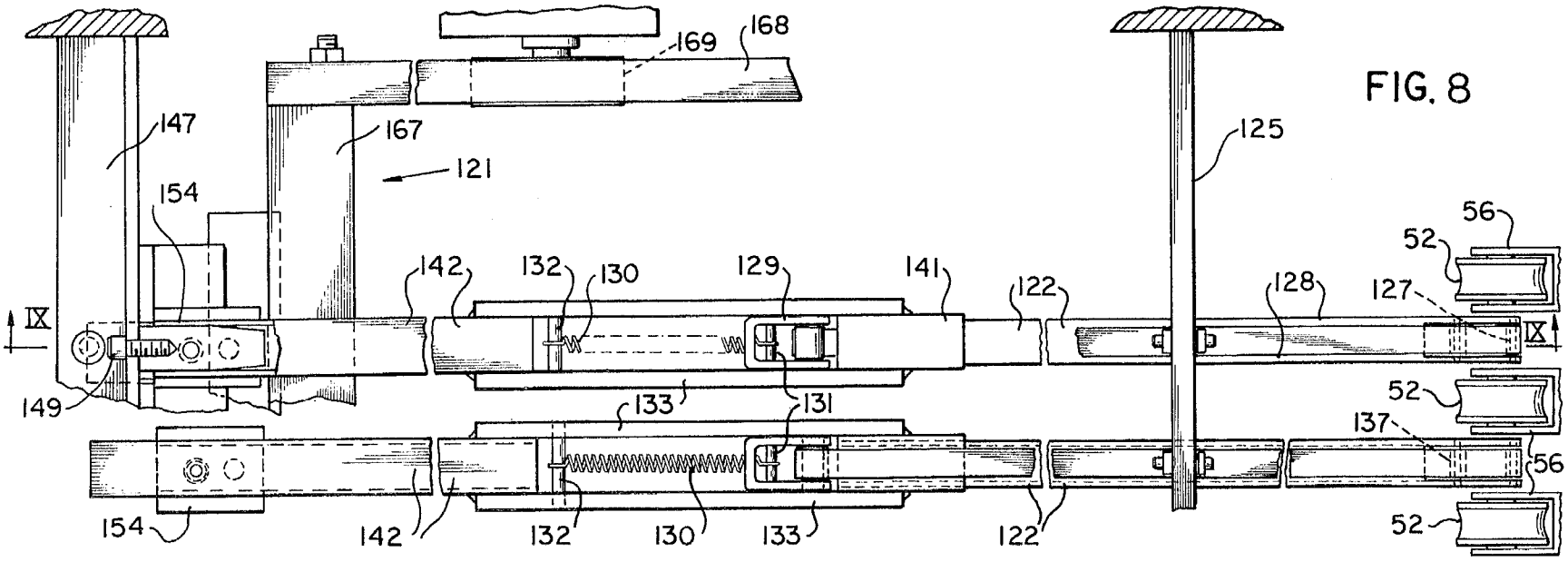
FIG. 8 is a fragmentary plan elevational view of a stack support spear assembly according to the present invention.
Figure 9:
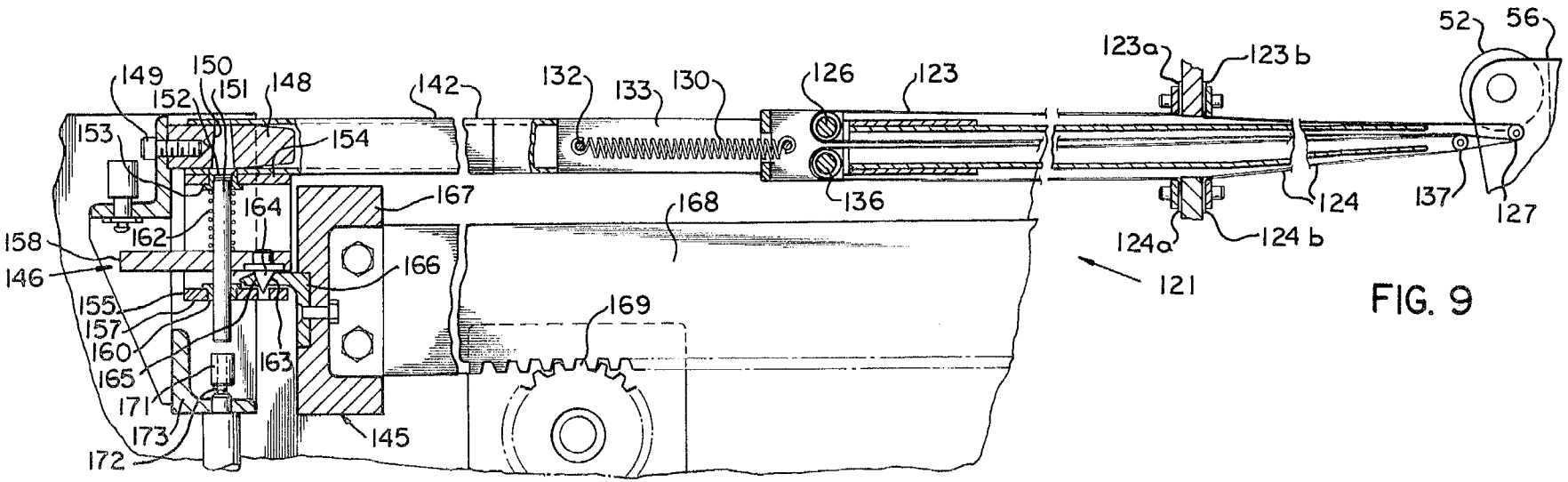
FIG. 9 is a cross-sectional view taken along the lines IX—IX of FIG. 8.

As illustrated in FIGS. 8 and 9, each spear assembly arm comprises a pair of upper 123 and lower 124 continuous loops of tape. One end **123*a* of the upper tape is secured, such as with bolt means, on a rearward face of the wall 125; while the other end 123*b* is similarly secured to a front face of the wall. Between the ends 123*a* and 123*b*, the upper tape is threaded about rollers 126 and 127 which are positioned at rear and front ends, respectively, of the spears 122. Each front roll 127 may rotate about a support shaft fitted across parallel sidewall members 128. The rear roll 126 is fitted for rotation on a shaft extending between the sidewalls of a U-shaped bracket 129. The U bracket is resiliently biased rearward by means of a spring 130 which is connected at one end to a first bar 131 within the bracket 129 and at its other end to a second bar 132. The second bar is fixedly mounted across two side plate members 133. The resilient bias of the bracket 129 serves to tension the tapes 123 and 124**.

Mounting of the lower tape 124 is generally in mirror image with the upper tape support members. There are corresponding front and rear rolls, 137 and 136 respectively, and a stationary wall member 135 which underlies the spear arms 122 and corresponds with the upper wall 125. The rear roll 136 extends within the U-bracket 129 coaxial with and directly beneath the upper tape rear roll 126. However, in order to effect a tapered forward end for each spear arm 122, the front roll 137 does not lie directly laterally of the rear roll 137, but lies a short distance vertically closer to the upper roll 127 as shown in FIG. 9. On each arm 122, the side plates 133 are secured at one end to a support piece 141 from which extends the arm sidewalls 128 and at the rear end to the forward surfaces of a hollow extension bar 142. Securement of the various pieces may, for example, be accomplished with welds.

The spear arms 122 are secured adjacent their rearward ends with a frame assembly 145. The frame serves to drive the spears 122 toward and away from the stacker station 5. The frame 145 includes respective sub-frames 146 connected to each individual spear arm. The sub-frames 146 are detachable so that a spear may remain fixed relative to the back and forth movement of the main frame. Spears are made detachable to permit placement of further stack divider plates in the stacker station when side-by-side sheet flows are being delivered from the conveyor. The spears are removed to create spaces along the rows of spears so that the divider assembly may pass between the extra plates 6 without obstruction. Each detachable sub-frame 146 is a lock mechanism which utilizes a stationary bracket 147 extending along the width of the spear assembly behind the spear arms. Extending outward from the bracket 147 and facing the rear end of each arm 122 is a generally cylindrical plug member 148 having a tapered forward end. The plug members 148 are fixably attached to the bracket by bolt means 149 and extend into open ends of the hollow bars 142. Each plug is formed with a vertically directed channel 150 for selectably receiving a lock pin 151. The upper end of the lock pin is slidably supported in a vertical opening 152 aligned beneath the channel 150. The opening 152 is formed in a tube insert 153 extending through the lower surface of each arm support bar 142 and an upper wall surface 154. The wall surface 154 is part of a hollowed bracket piece 155 having a bottom surface 157. The sidewalls of the tube member 152 serve to align the bars 142 and wall surfaces 154 while welds provide securement of the spear arms to the walls 154. The locking pin 151 extends downwardly through a plate 158 fixably attached, such as by welds, to the pin and then through an opening 160 formed in the bottom surface 157 of the bracket 155. Each pin is biased downwardly by means of a spring 162 extending between a lower surface of the tube insert 153 and an upper surface of the plate 158. Each plate carries an abutment member 163 having a downwardly directed detent surface 164 cooperatively received in a mating opening 165. The opening 165 is formed in a wall member 166 which is secured to a transverse beam member 167 extending the width of the spear assembly just beneath the spear arms 122. The beam 167 is connected with at least one opposed end to a rack piece 168 drivingly engaged by a pinion gear 169. The other end of the beam may be similarly supported or supported with corresponding idler elements. The spears and racks may be supported at various positions for lateral movement by means of known bearing surfaces, such as rollers.

At each spear arm, the spring bias of the plate 158 serves to locate the detent surface 164 within the opening 165 to lock the bracket 155 to the driven beam 167 and to locate the upper end of the lock pin 151 beneath the plug opening 150. In this manner, a spear arm is drivingly interconnected with the beam 167 and rack 168. To detach a spear arm from the beam 167, the spring bias 162 is opposed and the pin 151 is raised. A control member 171 having internal threads is adjustably movable along a threaded rod 172 fixedly secured in a stationary wall 173. When the control member 171 is sufficiently raised, it engages with the lower end of the lock pin to vertically move the pin against the bias of the spring 162. The pin can be so raised until the detent 164 is above the opening 165 and the upper portion of the pin extends within the plug opening 150. Accordingly, when the spear assembly as shown in FIG. 9 is moved forward, the beam 167 no longer carries the detached arm, which is stationarily supported at its rearward end on the plug member 148 and at an intermediate distance between the wall surfaces 125 and 135.

Figure 10:
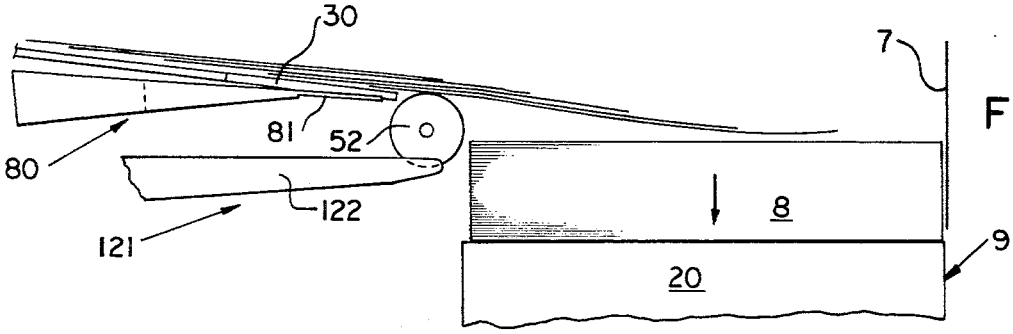

Referring now to FIGS. 10–16, the operation of the collector and discharge mechanism 1 will be explained. Sheets are continuously conveyed over the kick-off platform 30, propelled between the corrugating rollers 51 and 52, and passed out over the top of the stack 8 until their leading edges jog with the stop plate 7. When each sheet reaches the stop plate, it will have cleared the kick-off assembly and can deposit onto the top of the sheet pile 8 in the stacker 5. The sheets are collected on the table 9. The table is descended downwardly at the rate of growth of the stack keeping the stack out of the way of the flow of delivered sheets. Another way of describing the rate of descent of the table is that the table is lowered at a rate corresponding to the rate at which sheets accumulate in the stacker. In this initial position, the interrupter mechanism 80 and spear assembly 121 are at rest. Just before the desired number of sheets have passed onto the stack, the interrupter motor 90 is triggered and the interrupter plate 81 is driven into its upraised "ready" position as shown in FIG. 10.

Figure 11:
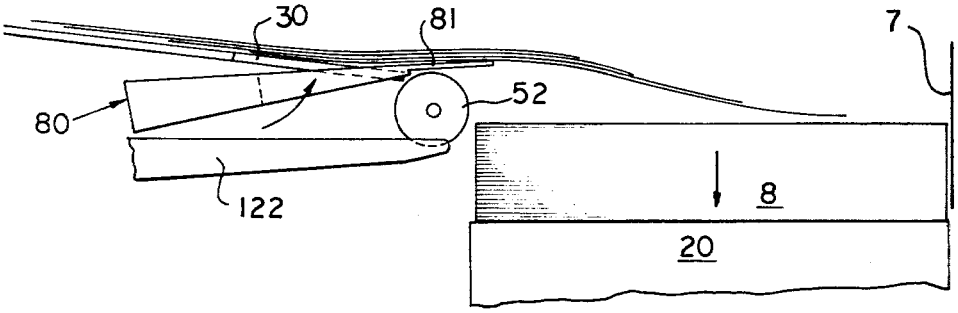
Figure 12:
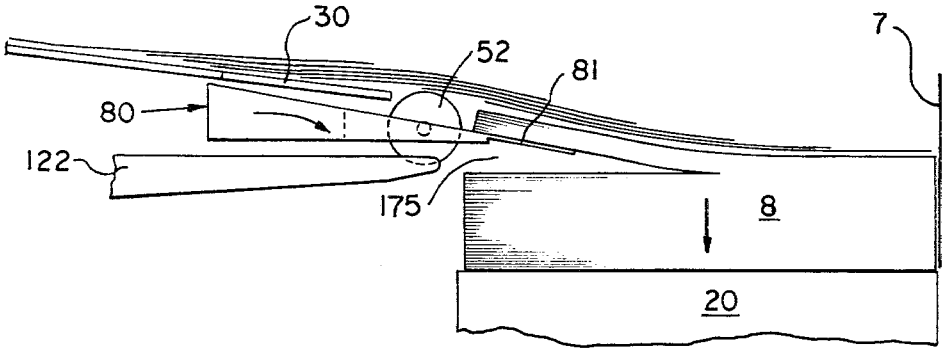
Figure 13:
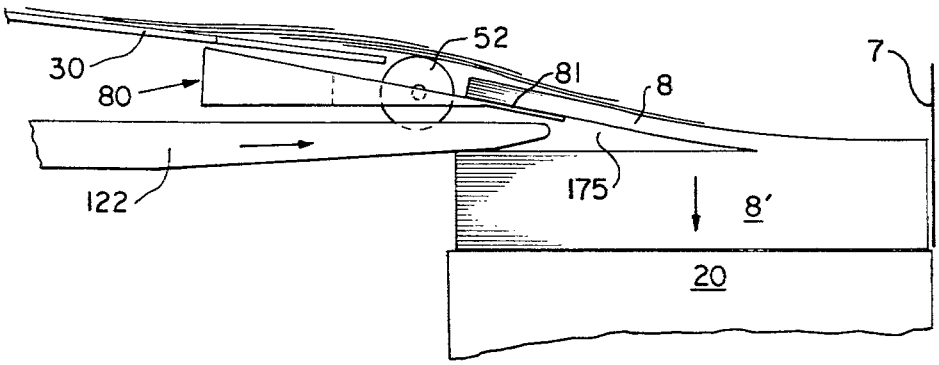

The interrupter brake 98 is released at the proper moment to intercede the plate member 81 beneath the next sheet after the last sheet for the desired batch 8′ has passed onto the stack (FIG. 11). The interrupter plate travels forwardly into the stacker stations at the same time it descends over the batch 8′. The interrupter plate is stopped when the interrupter guide rollers 84 and 96 reach the forwardmost points along their respective cam tracks. As shown in FIG. 13, the interrupter plate 81 then extends generally laterally into the stacker 5 and lies nearly parallel with the top of the batch 8′. The support table 9 continues its descent, however, thereby forming a wedge-shaped gap 175 between the successive sheets.

When the interrupter 80 is stopped at its forward point in its movement, a signal is transmitted to a drive means, such as an electric motor, to operate the drive pinion 169 for the spear assembly. As shown in FIG. 13, the spears pass laterally into the gap 175 towards the forward end of the stacker station 5 in order to divide and separately support the continually growing stack 8 above the desired batch 8′. As the spear arms 122 are being inserted into the stack, the interrupter is drawn back to its original "at rest" position (FIG. 14). For very long sheets, such as over 60 inches, a supporting ledge may be provided for the spear arms 122 at the forward end of their movement through the sheet stacker for better support to prevent excessive spear deflection and loads.

The upper and lower tapes 123 and 124 act as zero speed contact surfaces as they pass over the adjacent sheet surfaces, thereby preventing bunching or snagging of the stacked sheets. Timing of the spear insertion may be selected such that the downward taper at the forward portions of the lower tape loops 124 serves to compact the sheet batch 8′ in the stacker by squeezing out much of the air entrained between the sheets. In this manner, passage of a batch from the stacker is continuous even though the stack is also compacted and a subsequent compacting station is unnecessary. Compacting reduces the risk of pile distortion during subsequent transfer and handling.

Alternatively, compacting of the batch 8′ may be done in the stacker by temporarily halting downward movement of the support table at a predetermined point after the spear arms 122 have become fully extended into the stacker and are supporting the growing stack 8. As shown by the dashed lines and arrows in FIG. 14, the table 9 is then raised to engage the upper surface of the removed batch 8′ with the lower tape surfaces 124 to compact the sheet batch 8′. When compacting is afforded in this jogging fashion, insertion of the spears 122 into the stacker may occur after the cleft has had a longer time to form than when the tapered portion of the lower tapes 124 are used to compact the batch.

The table 50 is lowered away from the spears 122 at a relatively higher speed than when the sheets are accumulating on the table columns. The carrying columns 20 of the table pass downwardly between the spaced-apart belts 21 of the discharge conveyor to transfer the batch 8′ thereonto. Upon transference of the batch 8′, a signal activates the discharge conveyor motor 22 and the belts 21 passes the batch onto the upper surface of a discharge table 24 for further processing and packaging as illustrated in FIG. 15.

During the time when the spear assembly is supporting the sheet stack, the stack 8 is growing upward relative to the kick-off assembly 4. In order to continue the sheet flow delivery without the risk of sheets jamming the stacker 5, the kick-off assembly is raised to keep the delivery platform's leading edge and the pinch between the kick-off corrugating rollers 51 and 52 above the level of the top sheet in the stacker 5. Accordingly, passage of the support table 9 through a predetermined position may be used to trigger operation of the kick-off assembly elevator 60 such that the elevator rack 61 lifts the delivery end of the assembly 4 at relatively slow speed. This motion is indicated by the arrow 176 in FIG. 15.

After the batch 8′ has been propelled out of the way of upward movement of the columns 20, the table 9 is raised at high speed back into stacker station 5. The carrying columns pass through the spaces between the spear arms 122. After the table removes the stack from the spears, the spear assembly's drive pinion 169 is driven to pass the spear arms rearwardly out from the stacker (FIG. 16). After the spears 122 have been retracted from the stacker station 5, the table 9 resumes its downward descent at the growing rate of the stack and the kick-off assembly elevator is reversed to lower the assembly to its original position. This motion is illustrated by the dotted line arrows in FIG. 16.

Correlation of the various member movements within a collector and discharge mechanism 1 may be provided by known control devices. The movement of members, such as the spear assembly 121, which depend on the relative position of another member, (which in the case of the spears is the sheet support table 9) may be controlled by the activation of position limit or proximity switches when the controlling member reaches its critical position.

Figure 17:
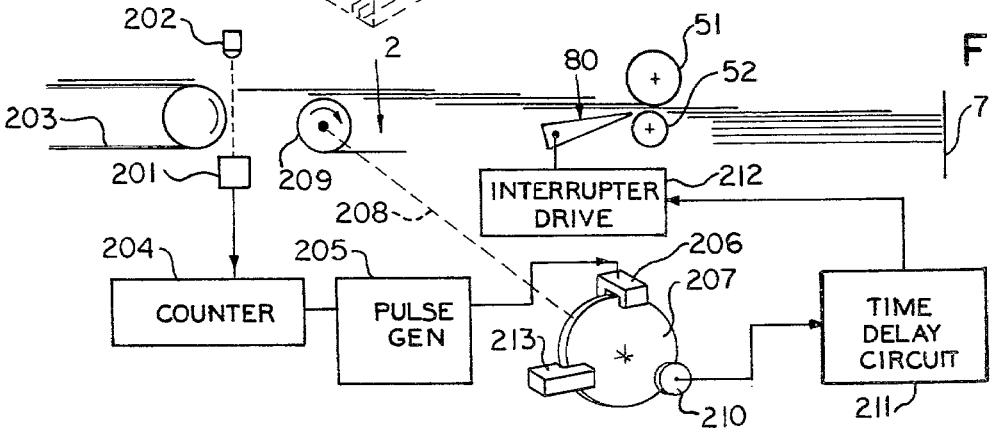
FIG. 17 is a schematic diagram of a sequence control system for use in timing interrupter firing.

Triggering of the interrupter operation may, for example, be performed by a system as shown in FIG. 17. With reference to FIG. 17, a photoelectric sensor 201 receives a signal from a light beam emitter 202 as each clip of sheeted material leaves the downstream high speed conveyor 203 of the sheet conveyor system for transfer onto the low speed delivery conveyor 31. With each signal, the sensor 201 sends a pulse to a counter 204. When the desired number of sheets for a batch has been reached, a pulse generator 205 transmits a short duration pulse to a recorder head 206 positioned adjacent a magnetic recording disc 207. The disc 207 is rotated in synchronization with movement of the low speed conveyor, such as by a direct interconnection 208 with the drive roll 209 for the conveyor, and sized so that one-half revolution of the disc corresponds to the travel of a sheet clip along the length of the low speed conveyor and over the delivery platform 33. Somewhat less than a half revolution away from the recording head 206 is a reading head 210, which, when it senses a pulse implanted on the disc by the recording head, activates a time delay circuit 211. The time delay may be fixed on the basis of predetermined system time constants for the particular collector and discharge mechanism as those skilled in the art will readily appreciate. A signal from the time delay circuit activates operation of the interrupter drive 212 at the proper moment so that the interrupter plate 81 is interjected between the top sheet of the desired batch and the bottom sheet of the successive stack. An erasing head 213 serves to clear the disc of the pulse signal after the pulse has passed the read head 210.

Figure 18:
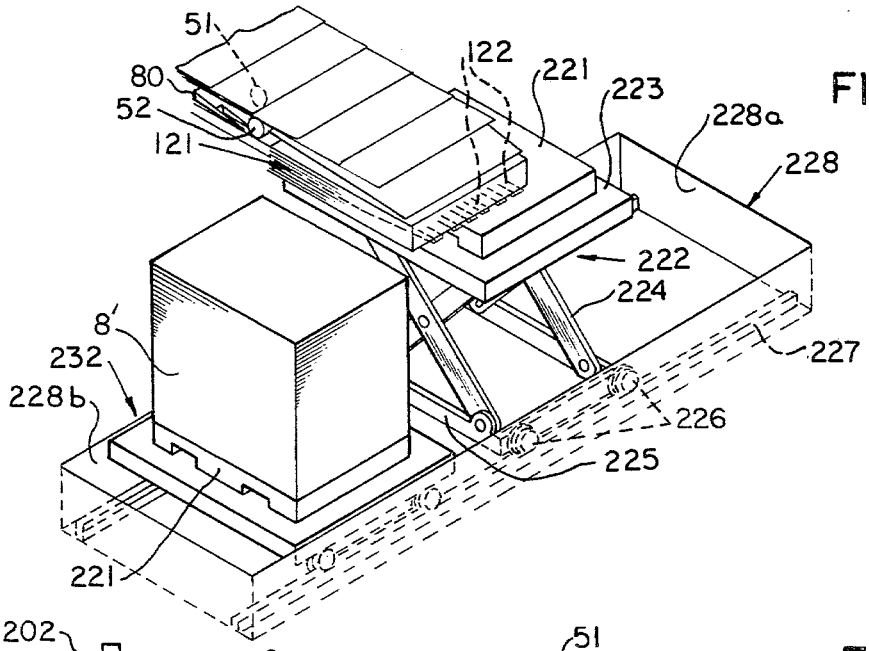
FIG. 18 is a perspective elevational view of a pallet table embodiment of the present invention.

The present invention encompasses variations in the mechanism elements. FIG. 18 illustrates a stack discharge arrangement by which sheets in the batch discharge means include pallets for carrying high stacks, even though the same interrupter and spear assembly as described above is utilized. Empty pallets 221 are passed into the stacker supported on interconnected first and second support platform assemblies 222 and 232. Each platform assembly comprises a table top 223 supported for vertical movement upon collapsible leg means 224. The lower ends of the collapsible legs are mounted in a base member 225 having opposed roller means 226 rotatable over linear tracks 227. The tracks run transversely beneath the stacker 5.

A linear drive means, such as a rack and pinion arrangement (not shown), serves to pass the platforms 232 and 222 back and forth along a dock member 228 over the tracks 227. As illustrated in FIG. 18, the platform assembly 222 is passed from one end **228*a* of the dock into the stacker 5 in an upraised position during the time the growing sheet stack 8 is being supported by the spear assembly 121. The pallet 221 arrives in the stacker at a level slightly below the bottom surfaces of the spear arms 122. The pallet may be formed with a series of spaced-apart longitudinally directed grooves (not shown) across its upper surface. These grooves enable the pallet to be passed upwardly in the stacker to lift the stack 8 off the upper spear surfaces in that the grooves receive the spear arms therein. After the pallet 221 assumes support for the growing stack 8, the spears are retracted as before and the platform table 223 is lowered at the growing rate of the stack. In the manner as above described, sheets are delivered into the stacker 5 onto the stack carried by the pallet 221. When a predetermined batch 8′ of sheets has accumulated on the pallet, the interrupter 80 is fired and a successive stack is divided out and separately supported above the batch by the spear assembly 121** in the manner as described above.

The loaded platform assembly descends to a lowermost discharge position with the batch 8′ (although the batch 8″ may first be briefly jogged upwardly against the bottom surfaces of the spear arms 122 to compress the stack 8′). The linear drive means returns the loaded platform from under the stacker station to its starting end of the dock in the opposite direction from which it entered the station. With respect to loaded platform assembly 232, it passes to the other end **228*b* of the dock. After the loaded assembly has stopped at its end of the dock, the pallet and batch 8′ are removed, such as by a fork lift truck and another empty pallet is placed on the platform table. The now empty platform is raised on its leg supports while the other platform is being lowered beneath the growing stack in the stacker 5. The now empty platform enters back into the stacker behind the discharging loaded platform and the process repeats such that sheet flow into the stacker 5** is continuous.

FIG. 19 shows an alternate embodiment for the sheet support table 9. Side plate 241 mounted adjacent opposed end surfaces of the table platform 19 support first 242 and second 243 shafts. The shafts extend transversely through the stacker station 5 and are fitted with rollers 244 spaced apart therealong. The rollers form end rolls for a series of conveyor belts 245. A drive transmission (not shown), which may be carried on the platform 19, is connected to one shaft to provide simultaneous drive of the conveyor belts. The upper surfaces of the belts serve as carrying surfaces on which sheets are supported in the stacker 5. The rollers are spaced apart and the shafts are sufficiently recessed to enable the carrying surfaces to pass between the spears 122 and lift the growing stack off the spears during operation of the collector and discharge mechanism 1. The table is particularly suited for handling smaller and lighter sheets, such as notebook paper reams.

Although various minor modifications may be suggested by those versed in the art, it should be understood that I wish to embody within the scope of the patent warranted hereon all such modifications as reasonably and properly come within the scope of my contribution to the art.

I claim as my invention:

1. A method for the collecting of sheets in a stacker and the discharge of sheet piles from said stacker, said method comprising:

continuously delivering sheets to a kickoff conveyor means, passing said sheets in a continuous flow from said kickoff conveyor means into said stacker, collecting said sheets in a pile in said stacker upon a carrying means, indexing said carrying means continuously downward at a rate corresponding to the rate at which sheets accumulate in said stacker, passing segregation means during said indexing into said stacker to segregate the top of said pile from the bottom sheet of a successive accumulation of sheets passing into said stacker, wherein said segregation means causes a cleft, inserting stationary support means into said cleft to stationarily support said successive accumulation in said stacker away from said pile, while simultaneously raising said kickoff conveyor means relative to said stationary support means to obviate obstruction of said continuous flow of sheets into said stacker with said successive accumulation, and transporting said pile on said carrying means away from said stacker.

2. The method according to claim 1 further comprising:

discharging said pile from said carrying means, bringing said carrying means back into said stacker to transfer thereto support of said successive accumulation from said stationary support means, retracting said stationary support means from said stacker, and lowering said kickoff conveyor means while simultaneously indexing said carrying means downward.

3. The method according to claim 2, wherein:

said carrying means is returned empty to said stacker and support of said successive accumulation is transferred thereto prior to accumulation of a pile on said stationary support means.

4. The method according to claim 1, wherein the step of inserting said stationary support means into said cleft is during said indexing of said carrying means.

5. The method according to claim 4 further comprising:

withdrawing said segregation means from said stacker as said stationary support means is being inserted into said stacker, said segregation means not engaging with said stationary support means.

6. The method according to claim 1 further comprising:

driving said segregation means along a fixed cam track such that said segregation means moves briefly upward from beneath said seriatim flow, enters into said stacker and passes downwardly therein to a predetermined point, and then follows a horizontal linear path retracting said segregation means from said stacker.

7. The method according to claim 1 further comprising:

providing said stationary support means with upper and lower abutment surfaces for engagement with opposed sheets across said cleft at substantially zero relative speed.

8. The method according to claim 7, wherein:

said pile is raised upward against lower abutment surfaces of said stationary support means to compress said pile before being transported away from said stacker.

9. The method according to claim 7, further comprising:

forming said lower abutment surfaces with a progressively downward taper and passing said stationary support means into said cleft so as to compact said pile with said lower abutment surfaces while said pile is being transported away on said carrying means.

10. A mechanism for the continuous collection and discharge of sheets in a stacker comprising:

means for supplying a continuous seriatim flow of sheets to said stacker, kick-off means for continuously passing said sheets from a delivery end thereof in said stacker, reciprocable table means for supporting sheets accumulating in said stacker in a vertical pile, said table means mounted for descent for a first period at a rate corresponding to the rate at which sheets accumulate in said stacker and for a second period for transporting a predetermined sheet pile accumulation out of said stacker for discharge, interrupter means for interceding a partition element into said stacker during said first period of descent to segregate said predetermined sheet pile from a succeeding stack accumulation of sheets, and divider means for inserting into said stacker to stationarily support said succeeding stack in said stacker during said second period of descent.

11. The mechanism according to claim 10, said divider means and said table means having interfitting elements.

12. The mechanism according to claim 10, wherein said kick-off means comprises:

an assembly supported for pivotal movement about a trailing portion, said assembly having a platform surface over which said sheet flow travels, a conveyor means mounted over said platform, and a series of twin sets of rollers mounted for free rotation downstream of the leading edge of said platform, the rollers of each of said twin sets receiving said delivery flow of sheets therebetween for forming stiffening grooves in the sheets.

13. The mechanism according to claim 10, further comprising:

discharge means for passing the sheet batch from said table means at the end of said second period of descent.

14. The mechanism according to claim 13, wherein:

said table means is able to move upward in said stacker and includes a series of spaced-apart upper table surfaces to support sheets thereon and said divider means comprises a series of spaced-apart spears for supporting said succeeding stack thereon, said spears extending along respective spaces between adjacent upper table surfaces such that an emptied table is able to pass through said divider means to retrieve said succeeding stack from said divider means.

15. The mechanism according to claim 14, wherein:

said discharge means comprises a series of spaced-apart belt means extending along respective spaces between adjacent upper table surfaces.

16. The mechanism according to claim 14, wherein:

each said upper table surface comprises an endless conveyor belt means, said conveyor belt means being part of said discharge means.

17. The mechanism according to claim 10, wherein said divider means comprises:

a spear assembly having a series of laterally spaced-apart spears, each said spear having upper and lower loops of tape extending longitudinally of said spear, each said loop of tape being fixed at opposed ends to stationary support means, said loops of tape being threaded over rollers at opposed ends of said spears to provide zero-speed contact surfaces against sheets in said stacker.

18. The mechanism according to claim 12, wherein said interrupter means comprises:

a base member, said partition element being a plate having its trailing end mounted in said base member, said base member having a roller means extending outward therefrom and being guided for movement by the path of said roller within a track, said track having an upper surface leading to a generally linear lower surface portion for stopping downward travel of said partition element.

19. The mechanism according to claim 10, wherein said table means includes:

first and second platform assemblies, each platform carrying a pallet upon which said stack forms in said stacker, said first and second platform assemblies having means enabling individual respective vertical movement thereof and means enabling simultaneous back and forth lateral movement into and out of said stacker.

20. The mechanism according to claim 19, wherein:

each said platform assembly includes a base member having wheels there attached for rotation, said wheels being positioned to ride over a linear track beneath said stacker.

21. An apparatus for separately supporting successive sheet accumulations in a stacker while further means serve to transport a sheet pile previously formed in said stacker away for discharge and until said further means returns to receive said successive sheet accumulations from said apparatus, said apparatus comprising:

a spear assembly including a lateral array of spaced-apart spears connected at their trailing ends with a frame and extending with their leading ends facing into the stacker, said frame being mounted for lateral movement on a fixed base, a drive means for linearly reciprocating said common frame into and out of said said stacker parallel to the longitudinal axes of said spears, means connecting said drive means to said frame, and a release means for selectively detaching individual spears from said common frame, said release means including a stationary bracket for supporting the trailing end of detached spears.

22. The apparatus according to claim 21, further comprising:

each said spear having upper and lower spaced-apart end roller means and respective upper and lower loops of tape threaded thereabout, respectived fixed support means above and below the lateral plane of said spears, each of said upper tapes having its ends in fixed relation to the upper said support means and each of said lower tapes having its ends in fixed relation to the lower support means.

23. The apparatus according to claim 21, wherein:

trailing ends of said spears are hollow and contain vertically extending holes through their respective lower surfaces, each said spear being connected at the lower surface of its trailing end with an individual connector frame, each said connector frame having a releasable detent means permitting selective interconnection of said connector frame with said reciprocable assembly frame, said lock mechanism further comprising an array of spaced-apart tubular plug members extending outward from said stationary bracket and able to fit into the hollow trailing end of a respective spear, each said plug member having a channel vertically extending therethrough for alignment with the lower surface hole of a spear when the spear assembly is in its fully retracted position, and a pin means mounted on each said connector frame for selective movement into and out of the respective plug channel through the respective lower surface spear hole.

24. The apparatus according to claim 23, wherein:

the pins means and said detent means fitted on each said connector frame form a common element such that release of said connector frame from said common asembly frame is simultaneous with interlocking of the respective spear onto the plug member.

25. In a stacker receiving a continuous flow of sheets, an improved apparatus for forming a cleft between consecutive sheets adjacent one edge of a sheet pile growing in said stacker on top of a movable table means, said cleft being for subsequent insertion of spear means therethrough to support a succeeding accumulation of sheets in said stacker while a previously predetermined sheet stack is transported out of said stacker by said movable table means comprising:

a partition plate having a leading end generally facing said stacker and a trailing end, a link member having said trailing end mounted at a top portion of said link member, a drive means having an actuator arm movable along a line located generally lateral of said stacker, said actuator arm being drivingly connected at a bottom portion of said link member, first and second rollers extending sideways from said link member at upper and lower portions of said link member, respectively, and first and second cam track means respectively receiving said first and second rollers, whereby said leading end intercedes between successive sheets in the flow of sheets into said stacker when said actuator arm is moved forwardly, said first cam track comprising a generally oval-shaped upper surface and a laterally linear lower surface and said second cam track comprising a laterally linear surface.

26. The apparatus according to claim 25, wherein: said sheet flow is shingled.

27. The apparatus according to claim 25, further comprising:

a damper mechanism for opposing abrupt movement of said second roller in said second cam track and a releasable latch means connected with said second roller for briefly holding said second roller at the rearward end of said second cam track after said actuator arm has begun forward movement such that said link pivots upwardly on said second roller to place said partition plate in a ready position adjacent said sheet flow prior to its intercession into said flow.

28. The apparatus according to claim 27, further comprising:

control means for releasing said latch means to permit forward motion of said second roller and selective firing of said partition plate into said sheet flow.

29. The apparatus according to claim 28, wherein said control means comprises:

a piston, a cylinder containing said piston, drive means for selectively reciprocating said piston into and out of said cylinder, and said latch means comprises a lever arm operatively engaged with said piston and a clock device being directly connected with said lever arm for restraining said second roller in said second cam track.

30. Apparatus for high-speed, continuous collection of sheets in a stacker comprising:

means supplying a continuous seriatim flow of sheets to said stacker, kickoff means for continuously delivering said sheets from a discharge end thereof into said stacker, table means movable continuously downward in said stacker for accumulating sheets thereon at a rate corresponding to the rate at which sheets accumulate in said stacker, interrupter means for segregating succeeding sheets from the top of a predetermined sheet pile formed on said table means by projecting a plate means into said stacker without changing the rate of downward movement of said table means, divider means insertable in said stacker for stationarily supporting said succeeding sheets over said table means, and elevator means for raising said discharge end upon insertion of said divider means in said stacker.

31. The apparatus according to claim 30, wherein said divider means comprises a plurality of spear elements mounted for lateral movement and formed with upper and lower abutment surfaces for engaging between sheets in said stacker at substantially zero relative speed.

32. The apparatus according to claim 30, wherein said table means is lowered in said stacker at a rate corresponding to the rate at which sheets accumulate in said stacker during projection of said plate means and insertion of said divider means.

33. The apparatus according to claim 32, further comprising discharge conveyor means for removing said sheet pile from said table means, said emptied table means being movable upward in said stacker to take over support of said succeeding sheets from said divider means and said elevator means lowering said discharge end after said succeeding sheets have been transferred to said table means.

34. The mechanism according to claim 10, said divider means being inserted into said stacker during said first period.

35. The mechanism according to claim 10, further comprising:

elevator means for raising said delivery end while sheets accumulate on said divider means in order to obviate obstruction of said flow of sheets with said succeeding stack.

* * * * *